United States Patent [19]

Cleaveland et al.

[11] 4,379,956

[45] Apr. 12, 1983

[54] BREAK-JAW CONSTRUCTION FOR A DISCONNECTING SWITCH STRUCTURE

[75] Inventors: Charles M. Cleaveland, North Huntingdon; Peter M. Kowalik, Trafford, both of Pa.

[73] Assignee: Cleaveland/Price Enterprises, Inc., Trafford, Pa.

[21] Appl. No.: 216,686

[22] Filed: Dec. 15, 1980

[51] Int. Cl.[3] ..... H01H 31/30; H01H 1/42

[52] U.S. Cl. ..... 200/48 A; 200/48 KB

[58] Field of Search ..... 200/48 R, 48 KB, 48 A, 200/162, 282, 271, 272, 273, 274

[56] References Cited

U.S. PATENT DOCUMENTS

| | | | |
|---|---|---|---|
| 2,610,276 | 9/1952 | Bayer | 200/48 A |
| 2,673,902 | 3/1954 | Heberlein | 200/48 A |
| 2,741,672 | 4/1956 | Harrison | 200/48 A |
| 3,182,145 | 5/1965 | Gorman | 200/48 A |
| 3,493,700 | 2/1970 | McKinnon | 200/48 R |

FOREIGN PATENT DOCUMENTS

| | | | |
|---|---|---|---|
| 897558 | 9/1959 | United Kingdom | 200/48 A |

*Primary Examiner*—John W. Shepperd
*Attorney, Agent, or Firm*—Willard R. Crout

[57] ABSTRACT

An improved switch-jaw construction is provided for a disconnecting switch having a tie-rod assembly interconnecting the free ends of the confronting switch jaw contacts. The tie-rod assembly includes preferably a metallic tubular member having its outer interior surfaces threaded to accommodate mounting bolts and the tie-rod assembly passes through apertures provided adjacent the free ends of the inwardly-turned switch-jaw contacts. Preferably mounting bolts are threaded into the interior threads of the tubular tie-rod within insulating bushings to prevent current flow into the tie-rod assembly, which would otherwise heat the compression springs and thereby cause them to loose their temper. As a result, lateral movement of the switch-blade pushing on either jaw contact, caused by the electromagnetic forces involved, or high wind loads or seismic loads will correspondingly carry the opposed jaw contact with the first-mentioned jaw contact thus maintaining constant good-contacting engagement between the movable switch-blade and the interior faces of the switch-jaw contacts.

4 Claims, 4 Drawing Figures

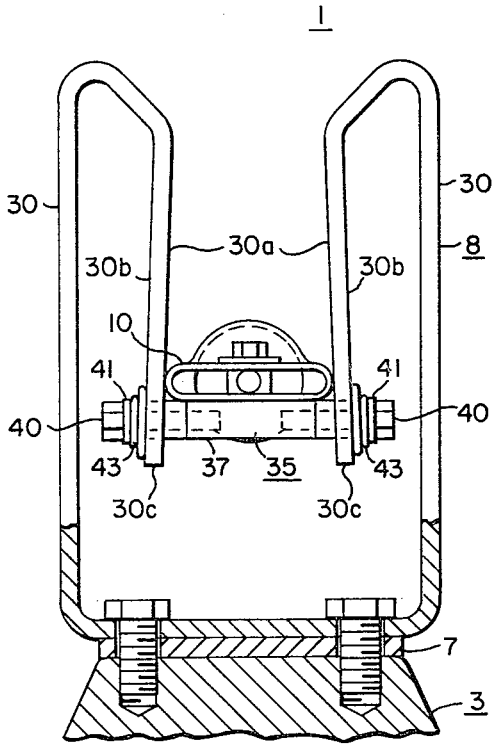
FIG.2.
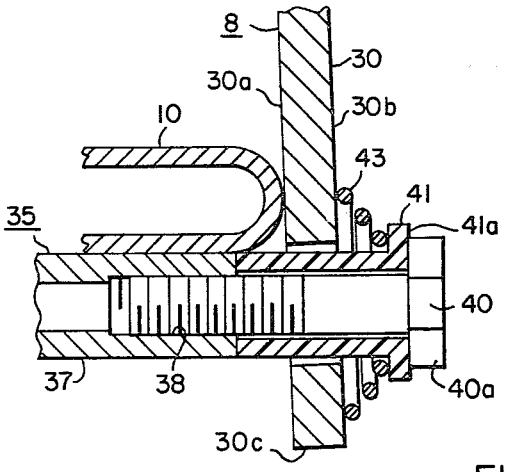
FIG.3.
FIG.4.
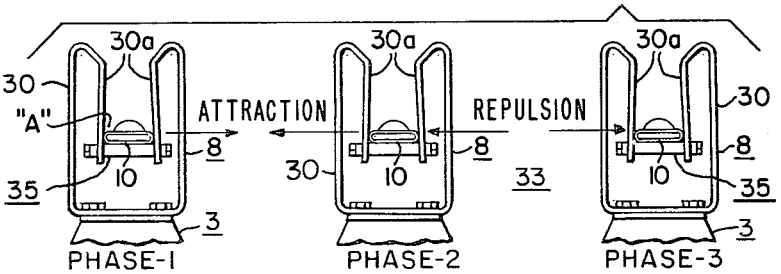

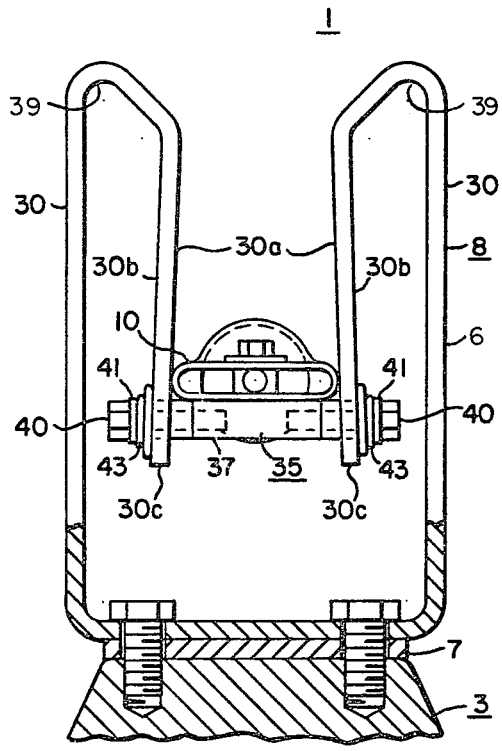
FIG.2.
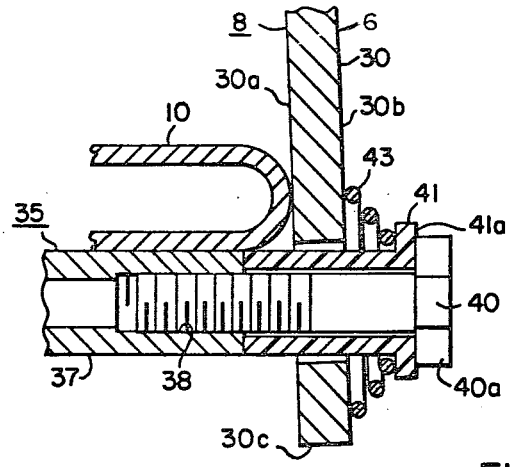
FIG.3.
FIG.4.
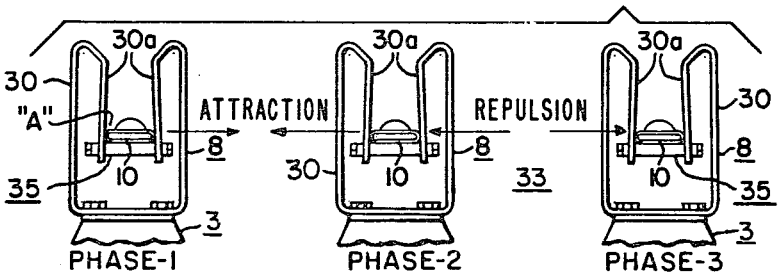

BREAK-JAW CONSTRUCTION FOR A DISCONNECTING SWITCH STRUCTURE

BACKGROUND OF THE INVENTION

1. Field of the Invention

This invention relates to disconnecting switches of the type in which a movable blade enters between a pair of confronting stationary opposed contact fingers and which is adaptable for carrying, at times, heavy currents, even approaching 100,000 amperes, for example.

2. Description of the Prior Art

Disconnecting switches of the prior art employed coil backup springs in the stationary contact structure bearing on the back sides of the stationary opposed contact fingers to attempt to thereby force the opposed stationary disconnecting contact fingers into good contacting engagement with the movable contact blade. However, even using such backup compression springs to attempt to ensure good contact pressure, nevertheless during heavy-current passage through the disconnecting switch, magnetic forces, wind forces and seismic forces would tend to diminish the contact pressure and would ultimately lead to burning and deterioration of the contact fingers, thus leading to a shortened contact life.

SUMMARY OF THE INVENTION

The present invention relates to an improved break-jaw construction for a disconnecting switch structure, particularly adaptable, but not necessarily limited to, three-phase switches for minimizing, or entirely eliminating the phase-to-phase magnetic attraction and repulsion forces applied between the adjacent switch-blades of multi-phase disconnecting switches. As well known by those skilled in the art, a disconnecting switch is preferably provided in series with circuit-breakers, or other line-controlling devices, so as to ensure an open, visible, disconnecting gap when the disconnecting switch is opened. This provides a desirable safety feature for maintenance personnel working on the associated power line.

A general object of the present invention is to provide an improved, simplified, highly effective switch-jaw construction for a disconnecting switch, which will minimize, or even entirely eliminate the detrimental action of the phase-to-phase attraction and repulsion forces which are applied between the three-phase switch-blades due to the magnetic fields involved, particularly during relatively high-current operation. If not counteracted, such magnetic attraction and repulsion forces can cause the break-jaw contacts to lose contact pressure with the movable switch-blade and thereby result in burning and a considerably shortened life of the switch-jaw contacts.

An additional object of the present invention is to provide an improved switch-jaw structure in which the cooperable inwardly turned jaw contacts are tied together by a tie-rod assembly, which causes one inwardly extending jaw contact to follow along with the opposing, or cooperable jaw contact when the latter is magnetically moved by the magnetic field of relatively high switch currents passing through the disconnecting switch structure. In other words, when one jaw contact is laterally moved by the switch-blade because of such magnetic repulsion and attraction forces, it will carry, by means of the tie-rod construction, the opposing switch contact along therewith, thereby maintaining a continued good contact between the switch-blade and the opposed confronting inward faces of the switch-jaw contacts. In other words, when the blade is moved magnetically from side-to-side, the jaw contacts are able to follow along with the blade in a "floating system" which can move without loss of the contact pressure applied by the contact springs.

Still a further object of the present invention is to provide an improved tie-rod construction for the inwardly turned switch-jaw contacts which will not only improve the contact engagement during short circuits between the movable blade and the switch-jaw contacts, but additionally will desirably serve as a stop member for causing a cessation of the closing movement of the movable switch-blade in the fully-closed-circuit position of the disconnecting switch.

Still a further object of the present invention is to provide an improved tie-rod construction for the opposed cooperable switch-jaw contacts in which the tie-rod member preferably passes through apertures disposed adjacent the inward free ends of the switch-jaws, and preferably one or more spring assemblies are utilized to exert a resilient spring force thereby maintaining good continuous contact pressure between the movable blade and the inwardly turned confronting faces of the cooperable switch jaw-contacts.

An ancillary object of the present invention is to provide an improved insulating bushing construction associated with the tie-rod assembly interconnecting the two inwardly turned switch-jaw contacts to prevent current passage through the spring assemblies, which would prevent the springs from heating and thereby losing their temper.

In accordance with the present invention, there is provided an improved disconnecting switch structure in which a tie-rod assembly passes through apertures provided near the ends of the inwardly-turned jaw contacts causing the two to generally move together, so that should one move laterally by electromagnetic attractive and repulsion forces, the other will also move therewith thereby maintaining good contacting engagement between the movable switch-blade and the cooperable inner faces of the switch-jaw contacts. Two spring assemblies are preferably interposed between the outer faces of the switch-jaw contacts and a pair of mounting bolts, which preferably additionally serve as seats for the pair of compression springs. Thus, the spring-biased tie-rod assembly causes the two inwardly turned jaw contacts to move in the same direction should such lateral movement occur for either jaw contact resulting from the interplay of electromagnetic forces during heavy current operation.

BRIEF DESCRIPTION OF THE DRAWINGS

FIG. 2 is an enlarged vertical partially sectional view taken along the line II—II of FIG. 1 looking in the direction of the arrows, with the switch structure being shown in the closed-circuit position;

FIG. 3 is a considerably enlarged vertical fragmentary sectional view taken through the tie-rod assembly of the switch-jaw contact structure of FIG. 2, and generally along the line III—III of FIG. 1; and, FIG. 4 is a diagrammatic view illustrating the principles of the present invention as applied to a three-phase disconnecting switch structure.

DESCRIPTION OF THE PREFERRED EMBODIMENT

Figure 1:
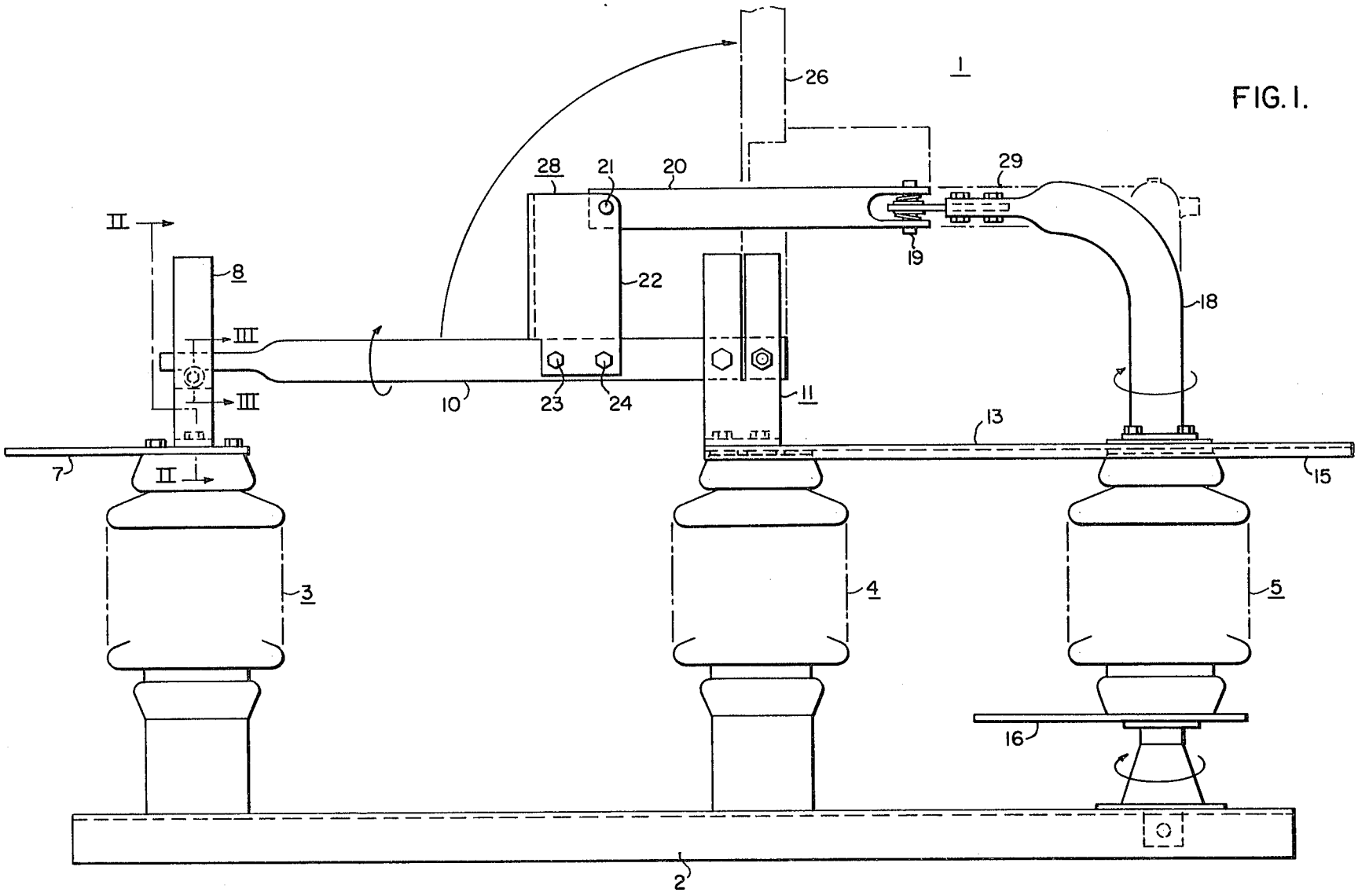
FIG. 1 is a side elevational view of a disconnecting switch structure embodying features of the present invention, the switch-blade being illustrated in the closed-circuit position with the dotted lines indicating diagrammatically the fully open circuit position of the switch-blade.

Referring to the drawings, and more particularly to FIG. 1 thereof, the reference numeral 1 generally designates a disconnecting switch structure having a base portion 2 of generally channel-shaped construction, and having supported upwardly therefrom, three post-type insulators 3, 4 and 5. At the upper end of the left-hand post insulator 3 is a line terminal connection 7 and a stationary switch contact assembly 8. Making electrical contacting engagement with the stationary switch contact assembly 8 is a movable switch-blade 10, the latter being pivotally mounted about a stationary switch contact assembly 11.

As illustrated in FIG. 1, the middle, or central post insulator support 4 assists in supporting at its upper end the switch contact assembly 11 and also a straplike terminal conductor 13, the latter extending across an outer rotatable insulator 5, and having its right-hand end forming a second line-terminal connection 15 for the disconnecting switch structure 1.

It will be observed that to effect the rotatable operating movement of the rotatable post insulator 5 there is provided a crank-arm 16, which may be rotated by any suitable operating means, not shown. Rotation of the crank-arm 16 will effect corresponding rotation of the rotatable post insulator 5 and thus also rotative action of an operating arm 18, the operating arm 18 being pivotally connected by a pivot pin 19 to a floating link 20, the left-hand end of which is pivotally connected, as by a pivot pin 21, to a generally U-shaped operating member 22, which is fixed, as by a pair of bolts 23, 24 adjacent the right-hand end of the movable disconnecting switch-blade 10.

With reference being directed to FIG. 1, it will be observed that in the open-circuit position of the disconnecting switch 1, the switchblade 10 moves to the dotted position 26, and the linkage 28, comprising the link 20, and the operating arm 18, moves to the dotted position 29.

As illustrated in FIG. 2, when the switch-blade 10 is fully closed and turned into the contact jaw structure 8, the contact fingers 30 on each side of the contact jaw structure 8 mate with the movable switch-blade 10. According to some prior-art structures, (not shown) there are provided coil springs, which exert forces between supporting structures and the jaw fingers to apply inward pressure to the movable switch-blade. Many of such prior-art structures have contact deficiencies during high-current short circuit conditions because of the existance of considerable electromagnetic forces, the interaction of which between the switch-blades of adjacent phases is more readily apparent from an inspection of FIG. 4 of the drawings.

With reference to FIG. 4 of the drawings, it will be observed that there is shown a three-phase disconnecting switch structure 33, which has phase-to-phase magnetic attraction and repulsion forces which are applied laterally magnetically between three movable switch-blades 10 due to the magnetic fields involved and are oscillating in direction and magnitude according to the alternating currents in each phase. As illustrated in FIG. 4, it can be seen how large magnetic forces, illustrated by the arrows, can cause conventional break-jaw contacts to lose contact pressure with the switch-blade 10 and thereby result in failure of the switch structure as a whole.

Looking at phase I of FIG. 4 of the drawings, the switch-blade 10 is pulled to the right. If the rod assembly 35 is not on the jaw, which is the case with conventional jaws, contact force on the right side of the switch-jaw structure 8 will increase, but the force on the left side of the switch-jaw structure will decrease. As the short-circuit current increases, a point will be reached where the left side, indicated by the arrow "A," will burn, or completely melt down. This problem occurs with all manufacturers' switch-jaw structures of which we are aware, even if coil springs are added between the inwardly-turned contacts and the member 30 or a similar cast supporting structure.

Note that there are other forces of repulsion between the inwardly-turned contact 30*a* and the member 30 which are caused by another magnetic field and which assist in combating the decrease in contact pressure as described above; however, the addition of the tie-rod brings a dramatic improvement in contact performance because both left and right contact fingers 30*a* are tied together to create a floating spring system that can move with the blade as it is forced from side-to-side by the magnetic field with amplitudes of as much as ½ inch under currents of 100,000 Amperes. Under such great currents the repulsion between the inwardly-turned contact finger 30*a* and member 30 are not great enough to compensate for the decrease in pressure from the phase-to-phase forces, and without the tie-rod assembly, contacts 30*a* can be damaged.

As illustrated in FIGS. 2 and 3 with more clarity, the improved switch-jaw contact structure 8 of our improved device includes a tie-rod assembly 35, which mechanically interconnects the lower inner free ends 30*c* of the switch jaws 30 in a manner more clearly shown in FIG. 3. It will be observed that the switch-jaw structure 8 comprises two outer contact sides 30, each of which has a reverse-bend contact portion 39, which extends inwardly in generally parallel relationship to its respective outer side wall portion 30. Preferably, the switch-jaw structure 8 is fabricated from a one-piece elongated metallic strip 6 of good conducting material having integrally formed therewith the outer contact sides 30, the reverse-bend portions 39 and the inner contact fingers 30*a*.

There is provided a tie-rod tube 37, which, for example, may be made of stainless steel, or brass. The ends of such tie-rod tube 37 are internally threaded, as at 38, and accommodate threaded tie-bolts 40, which may be made, for example, of bronze. The tie-bolts 40 preferably pass through insulating bushings 41, which have outer flange portions 41*a* serving as seats for compression springs 43. The aforesaid compression springs 43 may be made of stainless steel, for example, or phosphor bronze. The purpose of utilizing the insulating bushings 41, which may be made, for example, of nylon, is to prevent a possible current flow from the jaw contact 30 into the spring 43 into the tie-rod assembly 35, to the switch blade 10, which would heat the spring and would thereby cause it to lose its temper. As shown, the compression springs 43 are disposed between the rear sides 30*b* of the contact fingers 30 and the flange portions 41*a* of the insulating bushings 41.

FIG. 2 more clearly shows the switch structure 1 in the closed position in which the tie-rod assembly 35 additionally serves as a stop for the switch-blade 10 in its fully-closed-circuit position. Many switches of the prior art have additional structures serving as stops for the end closing position of the switch-blade, but such additional structures obviously increase the cost of the switch and moreover render it more complex in nature.

Accordingly, the tie-rod assembly 35, illustrated more clearly in FIGS. 2 and 3 of the drawings, not only serves to cause one switch-jaw contact finger 30*a* to carry the opposing contact finger 30*a* with it during lateral magnetically-forced movement, but, additionally, the tie-rod structure 35 serves as a stop limiting the closed-circuit movement of the switch-blade 10.

It has been noted in laboratory tests that conventional jaws need the conventional location of the blade stop as a second contact point in order to pass very high short-circuit tests. It was a second current path to compensate for the decreasing finger pressure caused by the switch-blade oscillations. Our new switch jaw structure does not need this second current path, which further illustrates its improved performance and allows the tie member 35 itself to be the movable blade stop. Additionally, it should be pointed out that the tie member 35 is electrically isolated by the insulating bushings 41, which keep the current from passing through the springs 43. This is done to keep springs 43 from heating and thereby losing their temper. The tie-rod assembly 35 of our structure does not function as a second current path to the switch jaw structure 8.

It should be noted that there are other forces such as high wind loads and seimic loads that can move switch-blades and cause contact pressure to be reduced to the point of damaging the contacts just as the magnetic forces do. The foregoing invention is also used to maintain good electrical contact under those conditions as well.

From the foregoing description it will be observed that we have provided an improved unitary tie-rod construction 35 which mechanically interconnects the free, inwardly-turned ends 30*c* of the switch contacts 30*a* thereby causing at all times good contacting pressure to be maintained between the movable switch-blade 10 and the jaw contacts 30*a* despite lateral motion of either one of the inwardly-turned switch-jaw contacts 30*a* resulting from the considerable lateral forces involved.

Although there has been illustrated and described a specific structure, it is to be clearly understood that the same was merely for the purpose of illustration, and that changes and modifications may readily be made thereby by those skilled in the art without departing from the spirit and scope of the invention.

What is claimed is:

1. A high-voltage disconnecting switch comprising a swinging movable disconnecting switchblade (10) making separable opening and closing contacting engagement with a stationary switch contact assembly (8), means pivotally mounting said swinging movable disconnecting switchblade (10) about a stationary pivot, said stationary switch contact assembly (8) comprising a confronting pair of inwardly turned contact fingers (30*a*) turned inwardly from their relatively stationary outer contact supporting strap portions (30), said inwardly turned contact fingers (30*a*) having apertures provided ajacent their lower free ends (30*c*), a floating tie-bolt assembly (35) extending through the two aforesaid apertures and constituting an end limiting stop for the completely closed circuit position of the swinging movable disconnecting switchblade when it is fully closed, whereby lateral movement of the switchblade (10) during the existence of heavy fault currents pushing one contact finger (30*a*) will cause the floating tie-bolt assembly (35) to carry the other opposed contact finger (30*a*) along therewith for good contacting movement with the switchblade, said floating tie-bolt assembly (35) including a metallic tube (37) having its outer ends interiorly threaded to accommodate mounting bolts (40), spring means (43) interposed between the head (40*a*) of each mounting bolt (40) and the outer face surface (30*b* ) of each contact finger (30*b*), and an insulating bushing (41) encircling each mounting bolt (40) and passing through the respective aperture in the contact finger (30*a*) to prevent current flow from the switchblade into the spring means (43).

2. A high-voltage disconnecting switch comprising a swinging movable disconnecting switchblade (10) making separable opening and closing contacting engagement with a stationary switch contact assembly (8), means pivotally mounting said swinging movable disconnecting switchblade (10) about a stationary pivot, said stationary switch contact assembly (8) comprising a confronting pair of inwardly turned contact fingers (30*a*) turned inwardly from their relatively stationary outer contact supporting portions (30) and being of substantial length, said inwardly turned contact fingers (30*a*) being laterally flexible relative to said outer portions (30), said contact fingers having their lower free ends (30*c*) being tied together by a tie-member (35), at least one spring (43) which maintains contact between said switchblade (10) and said contact fingers (30*a*) with a force substantially greater than the force necessary to laterally flex said contact fingers relative to said outer portions (30), and said movable disconnecting switch-blade (10) coming to an end resting position adjacent the lower free ends of the inner contact fingers (30*a*), thereby causing said contact fingers (30*a*) to follow with said switchblade (10) without loss of necessary contact pressure when said switchblade is moved laterally due to short-circuit currents or earthquake forces.

3. The combination according to claim 2, wherein the tie-member (35) constitutes an end limiting stop for the completely closed-circuit position of the swinging movable switchblade (10).

4. The combination according to claim 2, wherein said tie-member (35) includes a mounting bolt (40) and an insulating bushing (41) encircles the mounting bolt (40) and passes through an aperture in the contact finger (30*a*) to thereby prevent current flow from the switch-blade (10) through the spring (43).

* * * * *